US006899201B2

(12) United States Patent
Thiessen

(10) Patent No.: US 6,899,201 B2
(45) Date of Patent: May 31, 2005

(54) HOOP FOR A SAFETY CAGE ASSEMBLY OF A LADDER

(75) Inventor: Peter Thiessen, Sexsmith (CA)

(73) Assignee: Cage Industries Ltd., Beaverlodge (CA)

( * ) Notice: Subject to any disclaimer, the term of this patent is extended or adjusted under 35 U.S.C. 154(b) by 0 days.

(21) Appl. No.: 10/730,306

(22) Filed: Dec. 8, 2003

(65) Prior Publication Data

US 2004/0140154 A1 Jul. 22, 2004

(30) Foreign Application Priority Data

Jan. 16, 2003 (CA) ..... 2416390

(51) Int. Cl.[7] ..... E06C 7/18; E04G 1/00
(52) U.S. Cl. ..... 182/106; 182/230
(58) Field of Search ..... 182/129, 230, 182/106, 206, 93

(56) References Cited

U.S. PATENT DOCUMENTS 2,539,664 A * 1/1951 Hay ..... 182/230
3,106,986 A * 10/1963 Ray ..... 182/106
6,607,053 B1 * 8/2003 Warren ..... 182/106

* cited by examiner

*Primary Examiner*—Hugh B. Thompson, II
(74) *Attorney, Agent, or Firm*—Davis & Bujold, P.L.L.C.

(57) ABSTRACT

A hoop for a safety cage assembly of a ladder includes a rigid arcuate band having a first face, a second face, a first end and a second end. Each of the first end and the second end are secured to a ladder. A plurality of keyhole openings extend through the band between the first face and the second face. A plurality of detachable tubing clamps are provided. Each of the tubing clamps has tubing receiving jaws defining a tubing receiving opening with an axis. The tubing receiving jaws have an exterior mounted projecting attachment key. In a first orientation, the attachment key passes freely in and out through a selected one of the keyhole openings in the band. In a second orientation, the attachment key is locked within the selected keyhole opening and the tubing receiving jaws are oriented with the axis of the tubing receiving opening positioned transversely in relation to the band.

3 Claims, 6 Drawing Sheets

HOOP FOR A SAFETY CAGE ASSEMBLY OF A LADDER

FIELD OF THE INVENTION

The present invention relates to a hoop for a safety cage assembly of a ladder.

BACKGROUND OF THE INVENTION

Safety cage assemblies for scaffolding ladders generally consist of a plurality of hoops which are secured transversely to the ladder at regular spaced intervals. Scaffolding tubes are then secured to the hoops, so that the scaffolding tubes extend parallel to the ladder. The scaffolding tubes enclose the spaces between the hoops to provide fall protection. Hoops presently in use have tubing clamps welded to them. This makes the hoops heavy and difficult to manipulate into position by persons assembling scaffolding.

SUMMARY OF THE INVENTION

What is required is a hoop which is lighter and easier to manipulate by persons assembling scaffolding.

According to the present invention there is provided a hoop for a safety cage assembly of a ladder which includes a rigid arcuate band having a first face, a second face, a first end and a second end. Means are provided for securing each of the first end and the second end to a ladder. A plurality of keyhole openings extend through the band between the first face and the second face. A plurality of detachable tubing clamps are provided. Each of the tubing clamps has tubing receiving jaws defining a tubing receiving opening with an axis. The tubing receiving jaws have an exterior mounted projecting attachment key. In a first orientation, the attachment key passes freely in and out through a selected one of the keyhole openings in the band. In a second orientation, the attachment key is locked within the selected keyhole opening and the tubing receiving jaws are oriented with the axis of the tubing receiving opening positioned transversely in relation to the band.

The hoop, as described above, has detachable tubing clamps. This allows the hoop to be secured in position on the ladder, prior to the tubing clamps being attached. This innovation facilitates installation. There is no danger of the tubing clamps becoming detached during use, as the scaffolding tubing maintains the tubing clamps in the second orientation with the attachment key locked in the keyhole.

Although beneficial results may be obtained through the use of the hoop, as described above, even more beneficial results may be obtained when each of the first end and the second end of the band terminate in sleeves. The sleeves are oriented transversely in relation to the band and are adapted to slide over an end of a ladder. The sleeves serve as an effective and light weight means of securing the hoop to a ladder.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
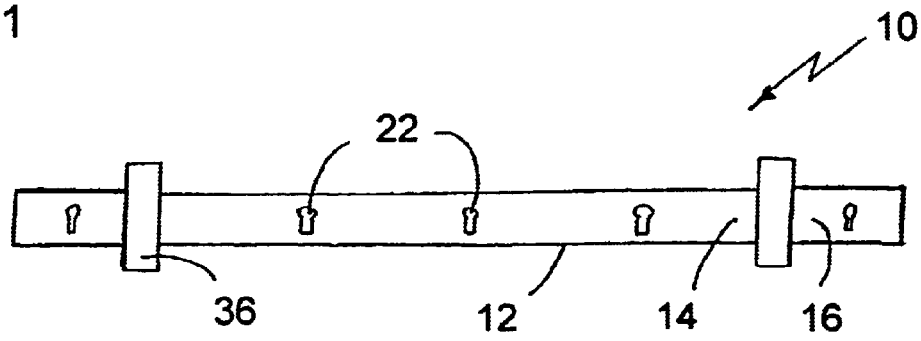
FIG. 1 is a front elevation view of a hoop for a safety cage assembly of a scaffolding ladder constructed in accordance with the teachings of the present invention.

The preferred embodiment, a hoop for a scaffold cage assembly for a scaffolding ladder generally identified by reference numeral 10, will now be described with reference to FIGS. 1 through 9.

Figure 2:
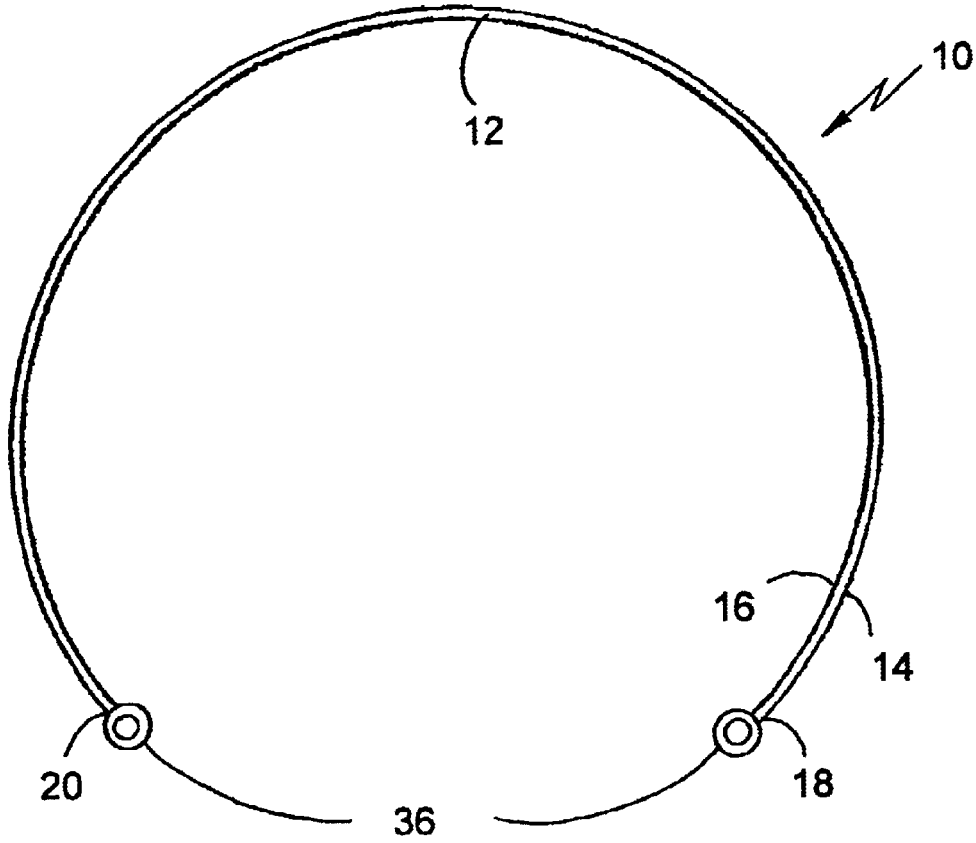
FIG. 2 is a top plan view of the hoop illustrated in FIG. 1.
Figure 3:
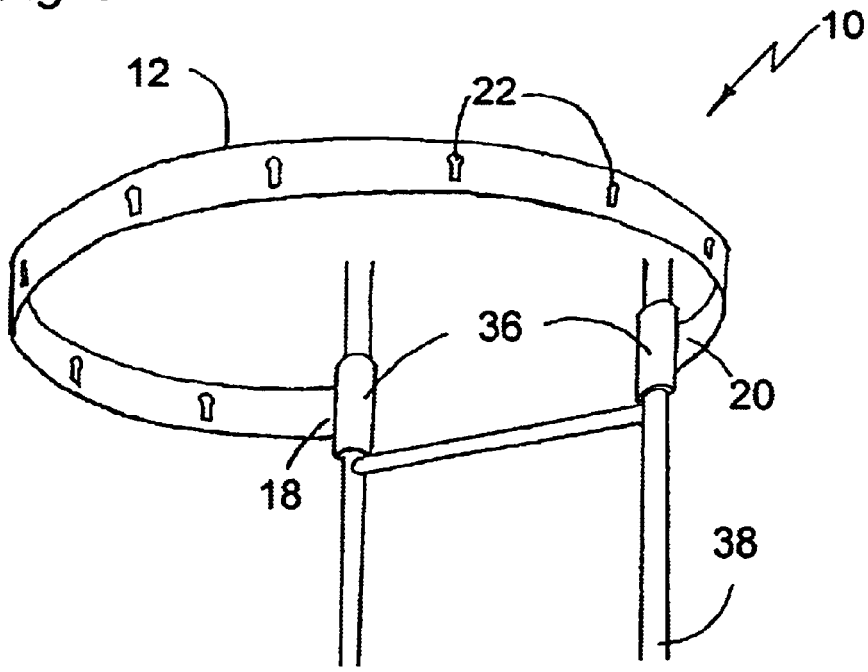
FIG. 3 is a perspective view of the hoop illustrated in FIG. 1 installed on a ladder section.

Structure and Relationship of Parts:

Referring to FIG. 2, hoop 10 is in the form of a rigid arcuate band 12 having a first face 14, a second face 16, a first end 18 and a second end 20. Referring to FIG. 1, a plurality of keyhole openings 22 extend through arcuate band 12 from first face 14 to second face 16. Referring to FIG. 2, first end 18 and second end 20 terminate in sleeves 36 which are oriented transversely in relation to band 12 and are adapted to slide over an end 40 of a ladder section 38. Sleeves 36 serve as the means for securing each of first end 18 and second end 20 to ladder section 38. Referring to FIG. 3, as will hereinafter be further described, when sleeves 36 are slid over end 40 of ladder section 38, it positions hoop 10 transversely across ladder section 38.

Figure 4:
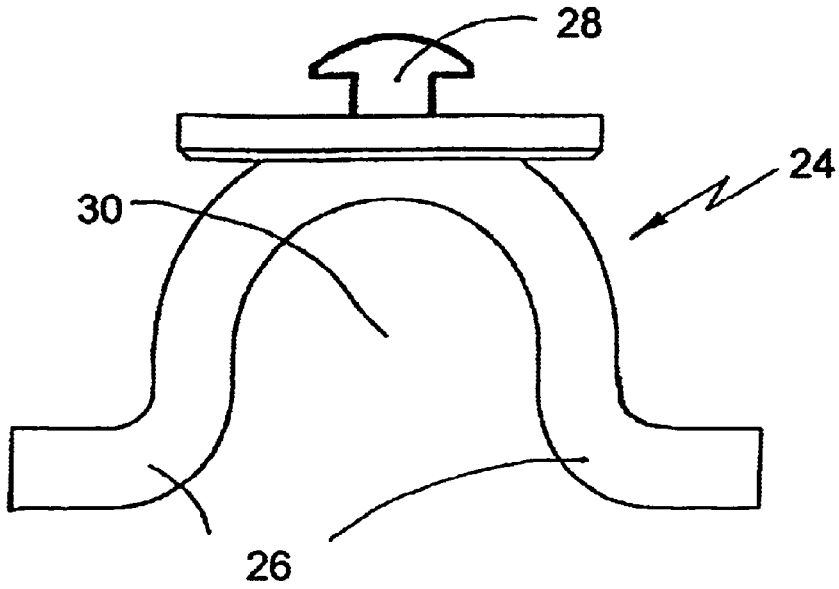
FIG. 4 is a top plan view of the receiving jaws of a detachable tubing clamp adapted to be detachably secured to the hoop illustrated in FIG. 1.
Figure 5:
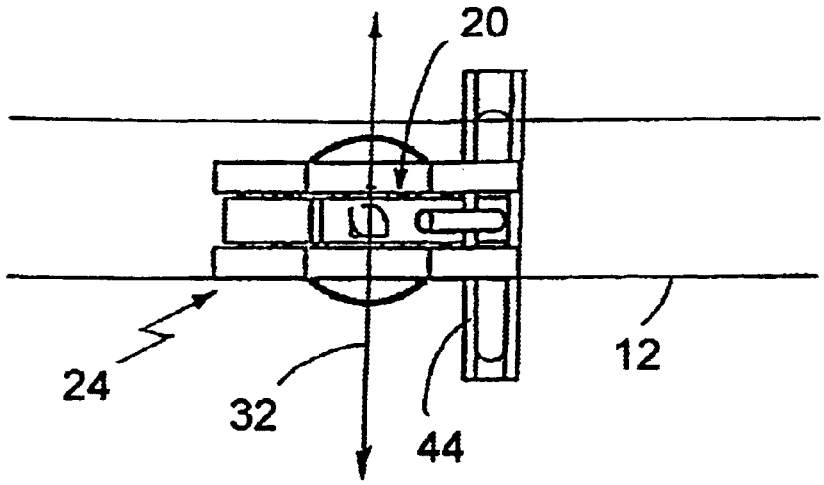
FIG. 5 is a side elevation view of the detachable tubing clamp illustrated in FIG. 4.
Figure 6:
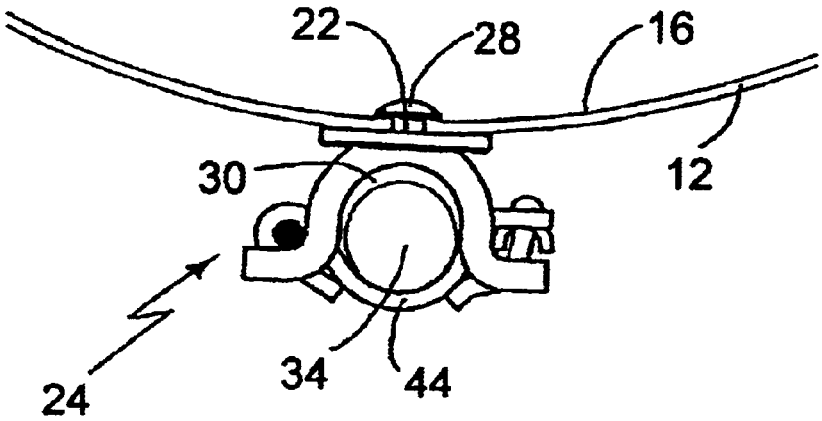
FIG. 6 is a detailed top plan view of the hoop illustrated in FIG. 1 with the detachable tubing clamp illustrated in FIG. 4 attached.
Figure 8:
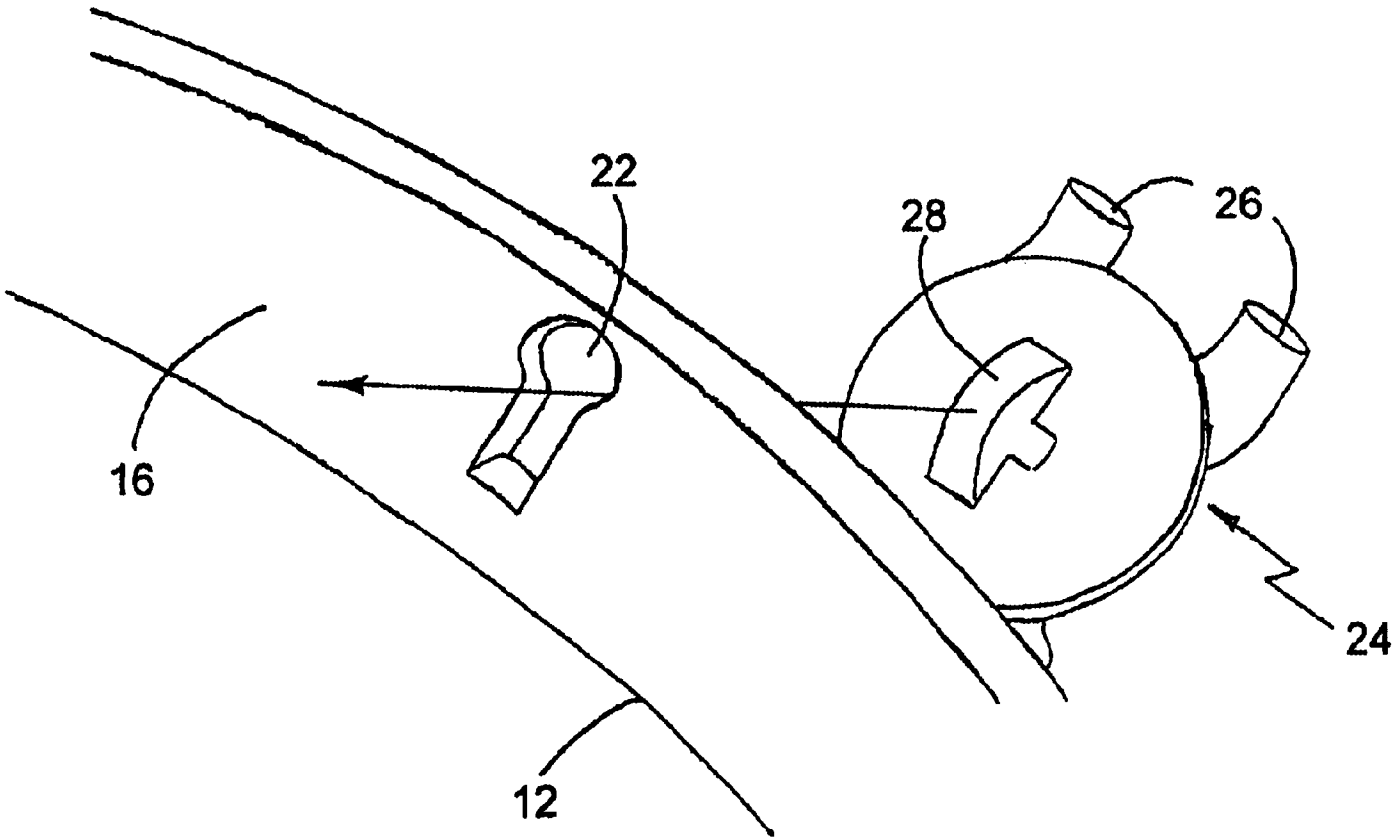
FIG. 8 is a detailed exploded perspective view of a scaffolding clamp with attachment member in a first orientation in relation to the keyhole opening in the hoop illustrated in FIG. 1.
Figure 9:
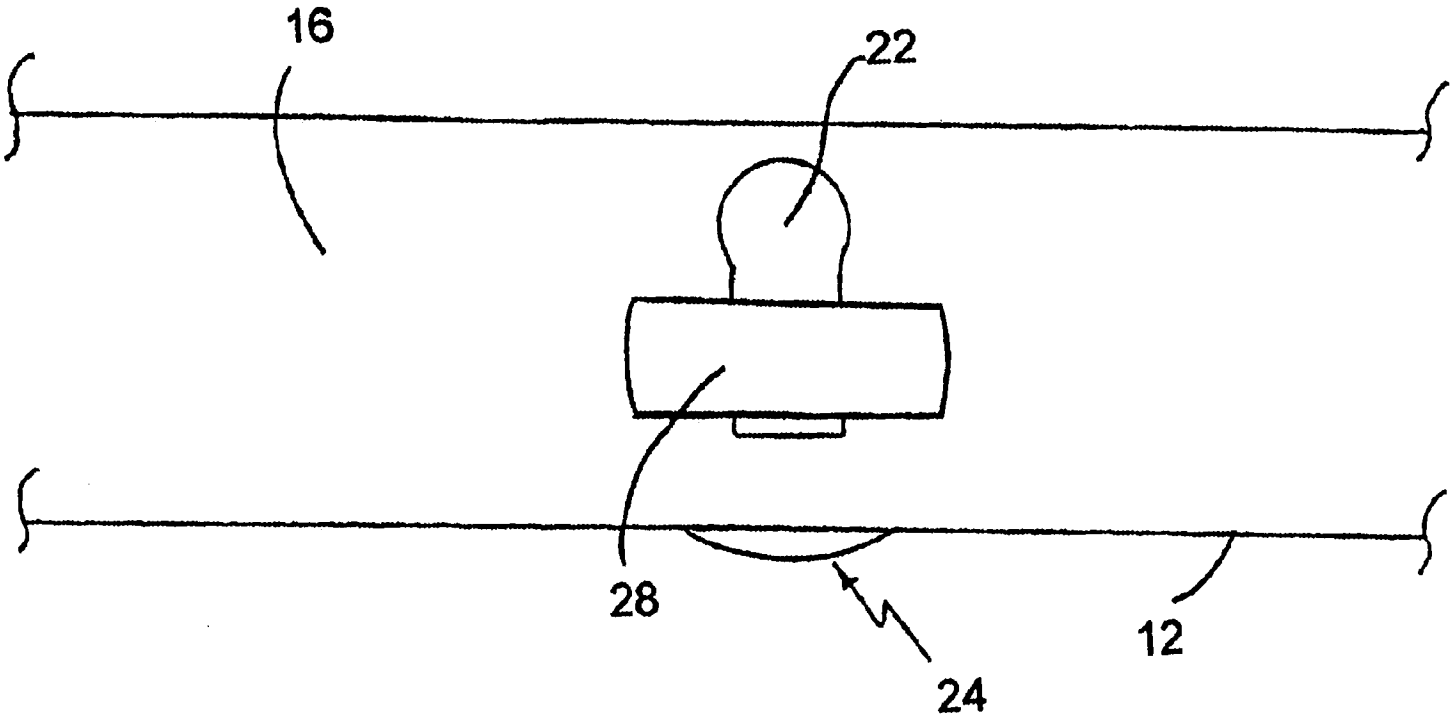
FIG. 9 is a detailed rear elevation view of a scaffolding clamp with attachment member in a second orientation in relation to the keyhole openings in the hoop illustrated in FIG. 1.

Referring to FIG. 6, there is illustrated a detachable tubing clamp 24. Referring to FIG. 4, tubing clamp 24 has tubing receiving jaws 26 and an exterior mounted projecting attachment key 28. Tubing receiving jaws 26 define a tubing receiving opening 30. Referring to FIG. 6, tubing receiving opening is closed by a closure portion 44 of tubing clamp 24 which spans between tubing receiving jaws 26. Referring to FIG. 8, when tubing clamp 24 is in a first orientation, attachment key 28 passes freely in and out through a selected one of keyhole openings 22 in band 12. Referring to FIG. 9, when tubing clamp 24 is in a second orientation attachment key 28 becomes locked within selected keyhole opening 22. Referring to FIG. 5, when tubing clamp 24 is in the second orientation, tubing receiving opening 30 has an axis 32 that is transversely orientated to arcuate band 12. Referring to FIG. 6, when scaffold tubing 34 is positioned in tubing receiving opening 30, tubing clamp 24 becomes locked in the second orientation and attachment key 28 can not be removed from keyhole opening 22.

Figure 7:
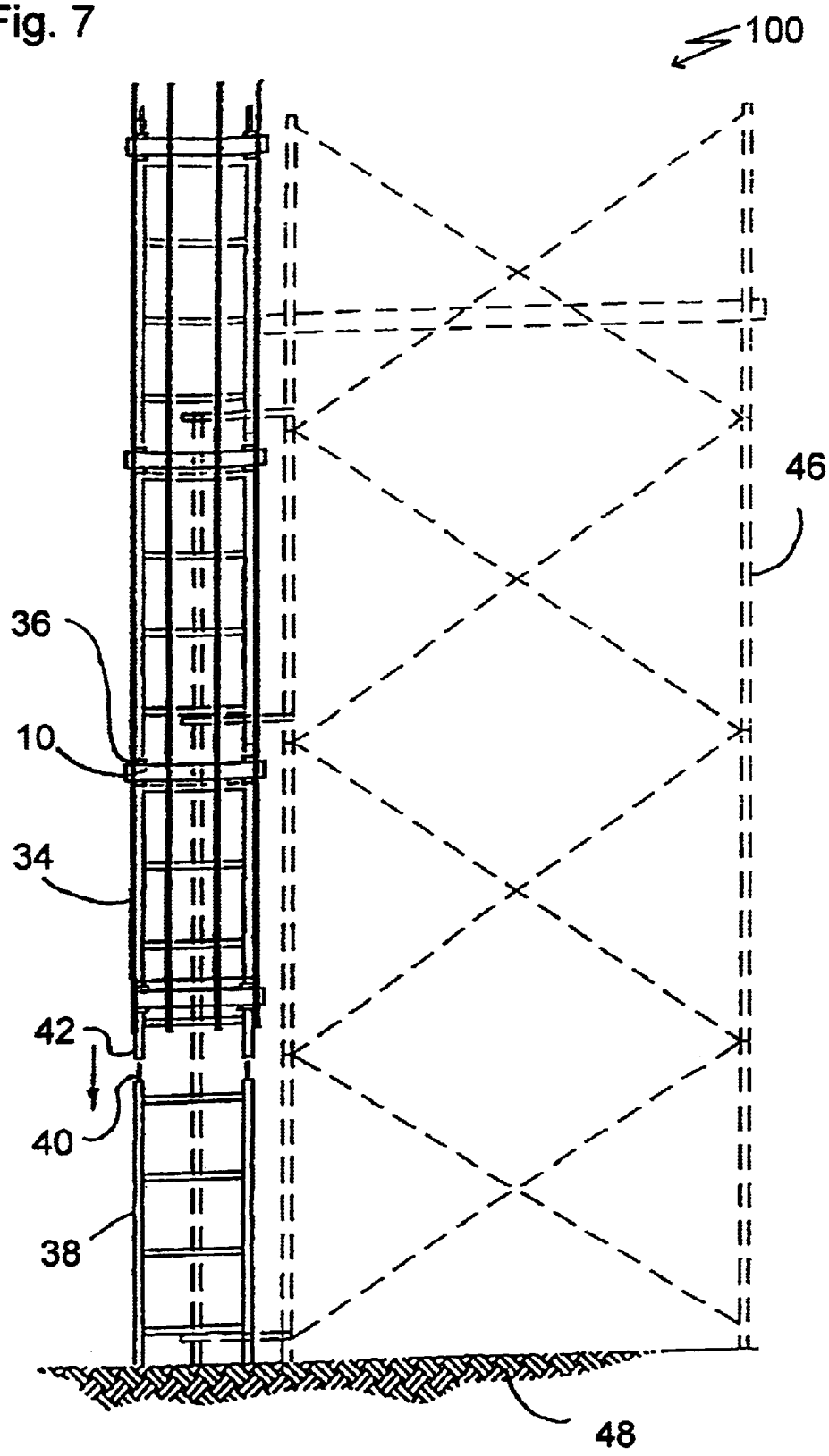
FIG. 7 is a front elevation view of a scaffold cage assembly constructed using the hoop illustrated in FIG. 1.

Operation:

There will now be described how hoop 10 is used as part of a scaffolding cage assembly with reference to FIGS. 1 through 7. Referring to FIG. 7, there is illustrated a scaffolding cage assembly generally identified by reference numeral 100. Typically, several ladder sections 38 will be required. Each ladder section 38 has a male end 40 and a female end 42. Each female end 42 is slid over a corresponding male end 40 to mate the ladder sections in end to end relation. Referring to FIG. 7, in the illustrated embodiment, four (4) hoops 10 are shown. Referring to FIG. 4, a plurality of detachable tubing clamps 24 is used depending upon the number of hoops 10 chosen and the number and orientation of scaffold tubings 34 desired. Referring to FIG. 7, four (4) scaffold tubings 34 in an evenly spaced and substantially parallel orientation to each other are shown. It will be understood that FIG. 7, is a simplification for the purpose of illustration. In the illustrated embodiment, sixteen (4×4) detachable tubing clamps 24 would be required to erect the illustrated embodiment shown. It will be appreciated that many combinations of scaffold tubings 34 and hoops 10 may be selected resulting, in each case, in a different number of detachable tubing clamps 24 used. Referring to FIG. 3, sleeves 36 at first end 18 and second end 20 of hoop 10 are positioned over end 40 of ladder section 38. Referring to FIG. 8, attachment key 28 of each detachable tubing clamp 24 is positioned in a first orientation allowing it to pass freely through each selected keyhole opening 22. Referring to FIG. 9, each tubing clamp 24 is turned to the second orientation. Referring to FIG. 5, this results in a transverse orientation of axis 32 of tubing receiving openings 30 to band 12. Referring to FIG. 6, scaffold tubing 34 are then positioned into each tubing receiving opening 30 to maintain tubing clamp 24 in the second orientation. Referring to FIG. 7, scaffolding tubing 34 is added to enclose hoops 10. Although only four sections of scaffolding tubing 34 have been illustrated, it will be appreciated that sufficient sections are used to completely enclose hoops 10. Referring to FIG. 6, as each scaffold tubing 34 is positioned within each tubing receiving opening 30 it is secured in place by closing and securing each tubing receiving opening 30 with closure portion 44 of tubing clamp 24. Referring to FIG. 7, as shown in broken lines, a scaffold structure 46 is fixedly attached to and supports scaffolding cage assembly 100, both distributing their weight at ground level 48.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A hoop for a safety cage assembly of a ladder, comprising:

a rigid arcuate band having a first face, a second face, a first end and a second end;

means for securing each of the first end and the second end to a ladder;

a plurality of keyholes openings extending through the band between the first face and the second face; and a plurality of detachable tubing clamps, each of the tubing clamps having tubing receiving jaws defining a tubing receiving opening with an axis, the tubing receiving jaws having an exterior mounted projecting attachment key, in a first orientation the attachment key passing freely in and out through a selected one of the keyhole openings in the band, in a second orientation the attachment key being locked within the second keyhole opening and the tubing receiving jaws being oriented with the axis of the tubing receiving opening positioned transversely in relation to the band.

2. The hoop as defined in claim 1, wherein each of the first end and the second end of the band terminate in sleeves, the sleeves being oriented transversely in relation to the band and being adapted to slide over an end of a ladder.

3. A scaffolding cage assembly, comprising in combination: several ladder sections, each of the ladder sections having a male end and a female end, such that the female end is slid over a respective male end to mate the ladder sections in end to end relation;

a plurality of hoops, each of the hoops consisting of a rigid arcuate band having a first face, a second face, a first end and a second end, a plurality of keyhole openings extending through the band between the first face and the second face, the first end and the second end of each band terminating in sleeves, the sleeves being oriented transversely in relation to the band and being slid over the male end of the ladder sections, such that the sleeves secure the first end and the second end of the band to the ladder;

a plurality of detachable tubing clamps, each of the tubing clamps having tubing receiving jaws defining a tubing receiving opening with an axis, the tubing receiving laws having and exterior mounted projecting attachment key, in a first orientation the attachment key passing freely in and out through a selected one of the keyhole openings in the band, in a second orientation the attachment key being locked within the selected keyhole opening and the tubing receiving jaws being oriented with the axis of the tubing receiving opening positioned transversely in relation to the band; and scaffold tubing secured in the openings of the tubing receiving jaws of the tubing clamps and extending between the hoops.

* * * * *

UNITED STATES PATENT AND TRADEMARK OFFICE

CERTIFICATE OF CORRECTION

PATENT NO. : 6,899,201 B2
APPLICATION NO. : 10/730306
DATED : May 31, 2005
INVENTOR(S) : Peter Thiessen It is certified that error appears in the above-identified patent and that said Letters Patent is hereby corrected as shown below:

Column 4, Claim 1, line 16: “second keyhole” should read --selected keyhole--.

Column 4, Claim 3, line 42: “laws” should read --jaws--.

Signed and Sealed this

Seventeenth Day of October, 2006

JON W. DUDAS
*Director of the United States Patent and Trademark Office*